US005375275A

United States Patent [19]

Sanders

[11] Patent Number: 5,375,275

[45] Date of Patent: Dec. 27, 1994

[54] PORTABLE SHOWER AND CATCH BASIN ASSEMBLY FOR CHEMICAL DECONTAMINATION

[75] Inventor: Dennis R. Sanders, Albertville, Ala.

[73] Assignee: Kappler Safety Group, Gunterville, Ala.

[21] Appl. No.: 143,615

[22] Filed: Nov. 1, 1993

[51] Int. Cl.[5] ..... A47K 3/23

[52] U.S. Cl. ..... 4/599; 4/613; 4/900

[58] Field of Search ..... 4/526, 527, 599, 600, 4/602, 603, 900, 612, 613, 614, 585, 582

[56] References Cited

U.S. PATENT DOCUMENTS

| | | | |
|---|---|---|---|
| 2,457,190 | 12/1948 | Werner | 4/614 |
| 3,080,568 | 3/1963 | Burnett | 4/599 |
| 3,681,788 | 8/1972 | Le Blanc et al. | 4/602 |
| 4,413,363 | 11/1983 | Troiano | 4/599 |
| 4,675,923 | 6/1987 | Ashley | 4/599 |
| 4,833,010 | 5/1989 | Langley | 428/287 |
| 4,890,343 | 1/1990 | Schlags | 4/585 |
| 4,928,581 | 5/1990 | Jacobson | 4/527 |
| 5,077,842 | 1/1992 | Horne, Jr. | 4/599 |
| 5,085,212 | 2/1992 | DeCosta | 4/526 |
| 5,169,697 | 12/1992 | Langley et al. | 428/57 |

FOREIGN PATENT DOCUMENTS

| | | | |
|---|---|---|---|
| 588545 | 12/1959 | Canada | 4/585 |
| 1434384 | 2/1965 | France | 4/612 |
| 2415906 | 10/1975 | Germany | 4/900 |
| 3301184 | 7/1984 | Germany | 4/582 |

*Primary Examiner*—Henry J. Recla
*Assistant Examiner*—Charles R. Eloshway
*Attorney, Agent, or Firm*—Joseph H. Beumer

[57] ABSTRACT

A portable shower and catch basin assembly for use in performing chemical decontamination procedures has a catch basin made of a highly effective chemical barrier fabric and a support framework of plastic tubing parts that may be erected quickly on site. The framework has vertical posts and horizontal support members provided with mating fittings that snap together. One of the posts has a vertical extension with a cradle that supports a shower pipe. The catch basin fabric is made up of a composite multilayer material resistant to permeation by a wide range of toxic chemicals.

12 Claims, 2 Drawing Sheets

PORTABLE SHOWER AND CATCH BASIN ASSEMBLY FOR CHEMICAL DECONTAMINATION

FIELD OF THE INVENTION

This invention relates to portable decontamination equipment.

BACKGROUND OF THE INVENTION

Effective response to emergencies involving release of hazardous chemicals requires use of portable decontamination equipment. In particular, portable showers are needed to enable quick removal of chemicals from the bodies and clothing of workers at the site of the emergency. Showers for this purpose should include a catch basin to retain contaminated water and thus prevent further release or spread of the hazardous chemicals into the environment through drainage systems or sewers. Containment of the chemicals requires a catch basin that not only holds water but also provides a barrier to permeation by all types of hazardous chemicals. This would enable retention of the chemicals where their nature and specific composition have not yet been determined at the time when initial decontamination is being performed.

Additional desired features for this equipment include a capability to be folded up into a compact package with a minimized volume for storage and a shower spray head designed to minimize the amount of water used.

Previously used portable showers known to applicant have failed to provide an adequate catch basin for containment of hazardous chemicals. In some cases, water used for the shower has been allowed to flow into conventional drains and sewer systems. Expedients for the catch basin such as plastic wading pools or the like have failed to provide the required barrier to permeation by many types of chemicals.

SUMMARY OF THE INVENTION

The present invention is directed to a portable shower and catch basin assembly for use in chemical decontamination procedures where workers and their clothing or other objects are sprayed to wash off the chemicals. The assembly includes a catch basin made of a highly effective chemical barrier fabric mountable on a quickly assembled support frame comprised of plastic pipes or the like. The frame also includes an upright post with a cradle at the top thereof for receiving and removably holding a shower pipe or "wand" which has a spray head at its distal end and a graspable portion at its proximate end.

The frame preferably has a rectangular shape with vertical members at each corner and horizontal members connecting the corners. Means are provided at each corner for snapping the parts together during erection. The catch basin has a bottom and sides corresponding to the support members, with top edges of the sides being folded over and seamed to provide tunnels through which the horizontal side members are threaded. A specific barrier fabric, effective against a wide range of chemicals, is preferably used for the catch basin, and an additional layer of plastic such as polyvinyl chloride is disposed on top of and joined to the barrier fabric at the top face of the bottom to provide abrasion resistance. A separate, unconnected layer of this material may also be placed under the catch basin for the same purpose.

The shower pipe or wand has its proximal end arranged for connection to a water hose, and its distal end includes a spray nozzle. Intermediate portions provide a hand grip and an adjustable valve, along with a portion that snaps into place for being removably supported by a cradle at the top of an extended vertical post.

It is therefore an object of this invention to provide a portable shower and catch basin assembly wherein effluent water may be retained.

Another object is to provide such an assembly having a catch basin with capability for preventing permeation and release of a wide range of toxic chemicals.

Another object is to provide such an assembly in a form amenable to rapid erection at the site of a chemical release emergency.

Other objects and advantages of the invention will be apparent from the following detailed description and claims appended thereto.

DESCRIPTION OF THE PREFERRED EMBODIMENT

Figure 1:
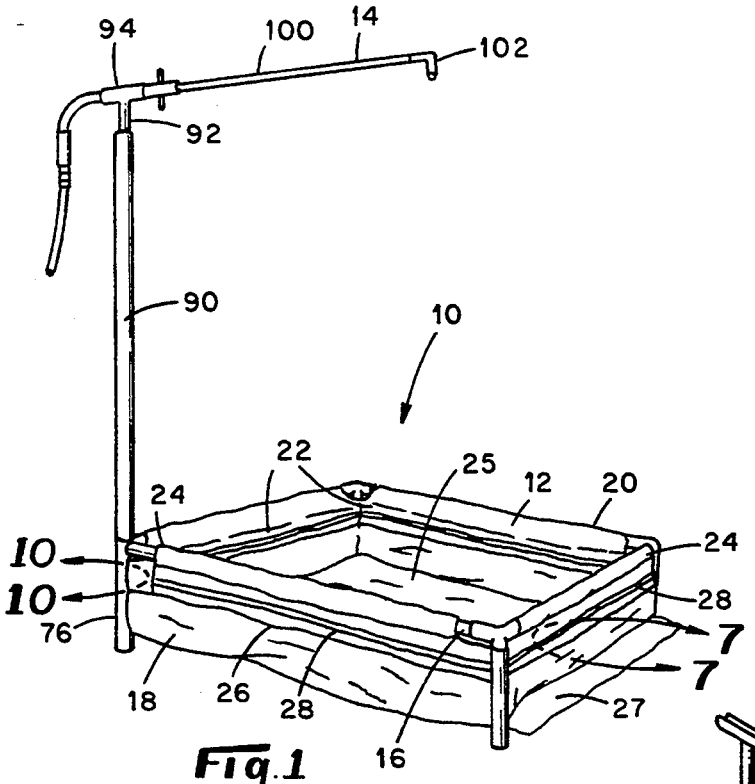
FIG. 1 is a perspective view of a portable shower and catch basin assembly embodying the invention.

Referring to FIG. 1 of the drawings, there is shown a portable shower and catch basin 10 in assembled condition for use in chemical decontamination. A catch basin 12 and shower 14 are supported by framework 16 comprised of plastic tubing. The catch basin in this embodiment is in the form of a fabric enclosure, of square shape and five feet long on each side, having a holding capacity of 185 gallons. Fabric 18 is folded over at the top 20 of each side 22 forming loops 24 through which pipes of the support frame are threaded. The loops are made secure by bonding of the folded-over edges 26 of the fabric to the side 22 by means of seaming tape 28 described in detail below. Such a tape may also be used for making bonded seams at other locations as required.

Figure 7:
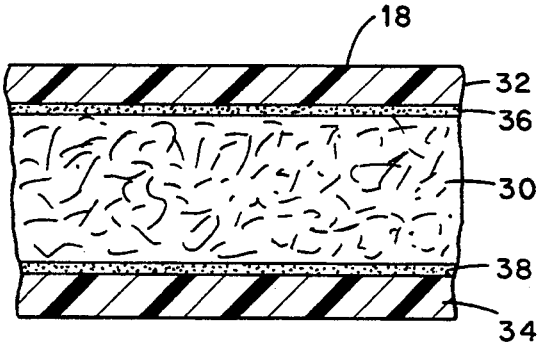
FIG. 7 is an enlarged sectional view of the chemical barrier fabric of the catch basin as seen along line 7—7 of FIG. 1.
Figure 8:
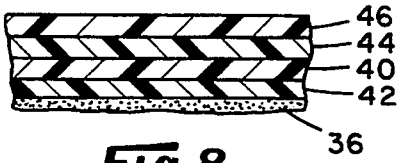
FIGS. 8 and 9 are enlarged sectional views showing further details of the fabric of FIG. 7.
Figure 9:
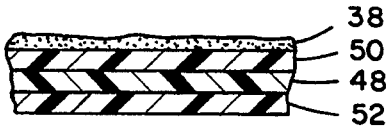

The fabric 18 used for the catch basin preferably comprises a multilayer composite barrier fabric as described in U.S. Pat. No. 4,833,010, issued on May 28, 1989, to John D. Langley. As shown in FIGS. 7, 8, and 9, this fabric has a base sheet 30 of nonwoven polypropylene with a first multilayer sheet 32 laminated to one face and a second multilayer sheet 34 laminated to the opposite face of the base sheet. Adhesive layers 36, 38 are placed between faces of the base sheet and the sheets 32, 34 laminated thereto. Multilayer sheet 32 as shown in FIG. 8 has a film 40 of ethylene vinyl alcohol sandwiched between film 42, 44 of nylon and bonded to an outer film 46 of linear low-density polyethylene. Multilayer base sheet 34 (FIG. 9) has a central layer 48 of polyvinylidine chloride, an inner layer 50 of ethylene vinyl acetate, and a outer layer 52 of low-density polyethylene. A layer 25 of polyvinyl chloride is applied to the top face of the bottom of the catch basin to provide abrasion resistance, and an unconnected mat 27 of the same material may be placed underneath the catch basin without being bonded thereto.

The composite barrier fabric described above exhibits high resistance to permeation by a wide variety of chemicals, in particular the 15 chemicals included in the ASTM F1001 Chemical Test Battery. Tests conducted using the procedure of ASTM F739 have shown that no breakthrough occurs during an eight-hour test procedure. This fabric is available commercially under the trademark RESPONDER ®.

Figure 10:
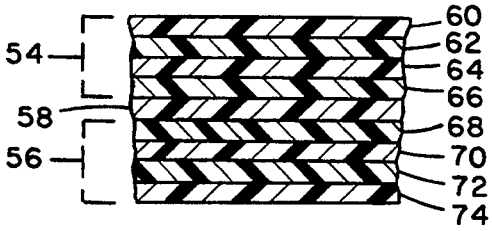
FIG. 10 is an enlarged sectional view of the seaming tape used in making the catch basin taken along line 10—10 of FIG. 1.

Seaming tape 28 as shown in FIG. 10 preferably comprises a heat-bondable tape as described in U.S. Pat. No. 5,169,697, issued on Dec. 8, 1992, to John D. Langley et al. This tape comprises two multilayer laminated sheet materials 54, 56, with a layer 58 of polyethylene disposed between the laminated sheets. Upper multilayer sheet 54 has an outer layer 60 of linear low-density polyethylene, a first layer 62 of nylon adjacent to the outer layer, a layer 64 of ethylene vinyl alcohol adjacent to the first nylon layer and a second layer 66 of nylon adjacent to layer 64. Multilayer sheet 56 has an upper layer 68 of chlorinated polyethylene and successive layers of ethylene vinyl acetate 70, polyvinylidine chloride 72, and ethylene vinyl acetate 74. Seams as required for all joints in the catch basin structure may be formed by placing adjacent pieces of fabric in edge-to-edge relation, disposing the tape to cover the joint and applying heat and pressure by means of a conventional air welding machine. In order to support the heavy load of accumulated water in the catch basin, a more durable seam may be obtained by stitching the fabric edges together and placing the tape in position to cover all stitching holes. Seaming tape is preferably placed on both sides of the fabric. By using the preferred seaming procedure, a complete barrier to the above-referenced chemical test battery is obtained for seams as well as for the fabric.

Figure 2:
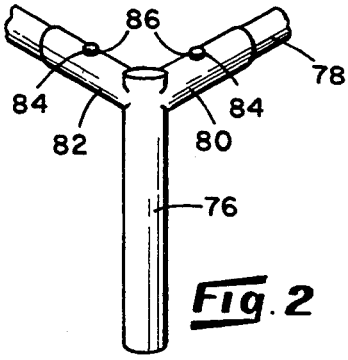
FIG. 2 is a fragmentary corner view showing a corner of the catch basin support.
Figure 4:
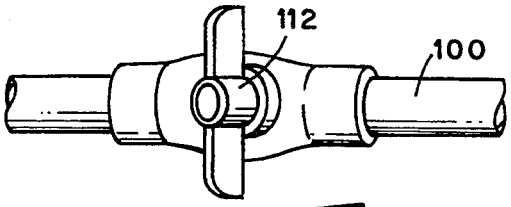
FIG. 4 is a fragmentary side view of the portion of the shower pipe which includes an adjustable valve.
Figure 3:
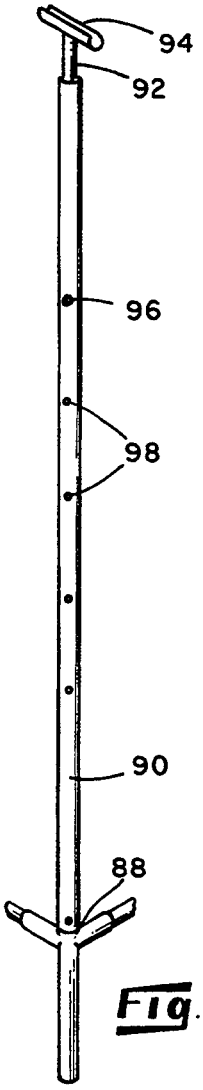
FIG. 3 is a fragmentary corner view showing another corner with an adjustable upright member and cradle for receiving a shower pipe.
Figure 5:
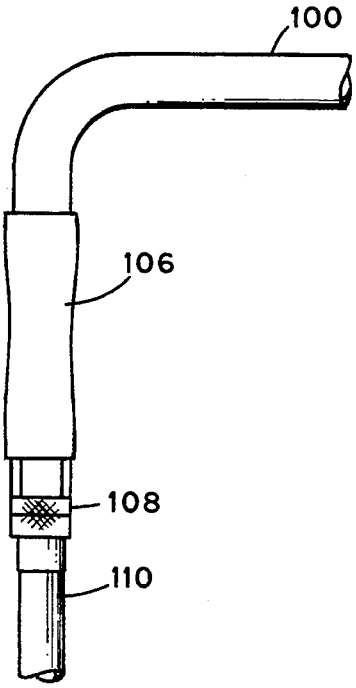
FIG. 5 is a fragmentary side view showing the graspable proximate end of the shower pipe.
Figure 6:
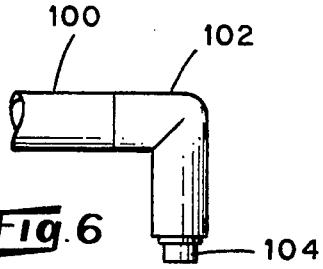
FIG. 6 is a fragmentary side view of the distal end of the shower pipe.

Framework 16 for supporting the catch basin is made up of four vertical corner posts 76 and horizontal members 78 connected to the posts, with all of these members being made up of polyvinyl chloride plastic tubing. As shown in FIG. 2, each corner post 76 has a pair of horizontal stubs 80, 82 disposed at right angles to one another and providing female receptacles for receiving ends of members 78. The horizontal members are secured in the stubs by spring-biased buttons 84, which are disposed to snap outward through apertures 86 in the extensions. This structure provides for rapid assembly and disassembly.

One of the corner posts 76 also has a vertical stub 88 for receiving upright shower support member 90. A spring-biased button 92 is carried by the stub 88 and is adapted to snap into position in aperture 94 as the base of support member 90. The upright support member coaxially receives an inner pipe 92 having a cradle 94 of generally U-shaped cross section disposed at the top of the pipe in a position slightly inclined from the horizontal and adapted to receive the shower pipe, the pipe snapping into position in the cradle. Pipe 90 carries a spring-biased button 96 adapted to be snapped in position in a selected one of a series of vertically spaced apertures 98. This provides for adjustment of the cradle to a height from four feet to eight feet. Shower 14 comprises an elongated pipe 100 having an L-shaped fitting 102 coupled to an adjustable nozzle 104 at its distal end and graspable handle 106 and a connector 108 coupled to water hose 110 at its proximate end. An adjustable shut-off valve 112 is disposed across pipe 100 at an intermediate position to control the flow of water to the shower nozzle. In operation, the shower may be supported at a selected height by placement in the cradle or it may be removed and held by means of handle 106 and moved around as required to wash off contaminants.

The shower and catch basin assembly as described above folds up into a compact volume and may be conveniently stored and transported in a generally cylindrical carrying case only slightly longer than the side members and having a diameter of less than a foot, with the packed assembly having a total weight of less than 25 pounds.

While the invention is described above in terms of a specific embodiment, it is not to be understood as limited thereto, but it limited only as indicated by the appended claims.

I claim:

1. A shower and catch basin assembly for performance of chemical decontamination comprising:

a catch basin support framework comprising a plurality of vertical support posts, horizontal fabric support members, and connecting means, said horizontal members, when erected, defining a polygon spaced apart from, above, and parallel to bottom ends of said posts, with a post located at each corner of said polygon and connected by said connecting means to adjacent ends of said horizontal support members;

a catch basin comprising a composite, flexible chemical barrier fabric sheet having a bottom portion and a plurality of side portions corresponding to sides of said polygon, sides of said fabric along top edges thereof being adapted for engagement with said horizontal members, said side portions of said fabric sheet being secured to said bottom portion to provide, when erected, an open-topped, liquid-tight enclosure having a horizontal bottom area defined by said bottom portion;

shower pipe support means comprising an elongated upward extension of one of said support posts and including means for receiving a shower pipe; and shower water delivery means comprising a delivery pipe adapted to be coupled at its distal end to a spray nozzle and at its proximate end to a water supply and including an intermediate portion engageable with said shower support.

2. The assembly as defined in claim 1 wherein said horizontal members define a rectangle.

3. The assembly of claim 2 wherein said vertical posts and horizontal members are comprised of plastic tubing.

4. The assembly of claim 3 wherein said connecting means comprises a pair of tubular horizontal stubs on said posts formed at right angles to one another and adapted to receive and support an end of a said horizontal member.

5. The assembly as defined in claim 4 wherein ends of each of said horizontal members include a radially outward biased projecting button, and end portions of said stubs each have an aperture for receiving a said button whereby said members may be removably connected to said stubs.

6. The assembly as defined in claim 5 wherein upper edges of said sides of said fabric sheet are folded over and seamed, providing a tunnel extending longitudinally along said edges for insertion therein of said horizontal support members.

7. The assembly as defined in claim 6 wherein said shower pipe support means comprises a U-shaped cradle connected to said extension removably receiving said shower pipe.

8. The assembly as defined in claim 7 including means carried by said extension for adjustably supporting said cradle at a selected one of a plurality of vertical positions.

9. The assembly as defined in claim 8 including a graspable handle portion of said delivery pipe adjacent to said proximate end thereof.

10. The assembly as defined in claim 1 wherein said chemical barrier fabric comprises a base sheet of nonwoven polypropylene having laminated to one face thereof a first multilayer sheet comprising a film of ethylene vinyl alcohol sandwiched between films of nylon with an outer film of linear low-density polyethylene bonded to a said nylon film and said base sheet having laminated to a second face thereof a second multilayer sheet having a central layer of polyvinylidine chloride, an inner layer of ethylene acetate, and an outer layer of low-density polyethylene.

11. The assembly as defined in claim 10 wherein said bottom portion of said catch basin has a top face and a bottom face and including a sheet of polyvinyl chloride bonded to said top face.

12. The assembly as defined in claim 11 including a sheet of polyvinyl chloride placed underneath said bottom face of said catch basin.

* * * * *